US006510362B1

(12) United States Patent
Guillermin

(10) Patent No.: US 6,510,362 B1
(45) Date of Patent: Jan. 21, 2003

(54) METHOD OF DETERMINING THE TRAJECTORY OF THE GROOVE TO BE MACHINED IN THE EDGE OF A LENS TO BE FITTED TO A "METAL SUPRA" TYPE SPECTACLE FRAME

(75) Inventor: Laurent Guillermin, Paris (FR)

(73) Assignee: Essilor International, Chareton le Pont (FR)

( * ) Notice: Subject to any disclaimer, the term of this patent is extended or adjusted under 35 U.S.C. 154(b) by 0 days.

(21) Appl. No.: 09/422,333

(22) Filed: Oct. 21, 1999

(30) Foreign Application Priority Data

Oct. 22, 1998 (FR) ..... 98 13243

(51) Int. Cl.[7] ..... G06F 19/00; B24B 1/00
(52) U.S. Cl. ..... 700/187; 451/43; 451/5
(58) Field of Search ..... 700/187; 451/5, 451/42, 43, 69, 240, 390

(56) References Cited

U.S. PATENT DOCUMENTS 5,363,597 A * 11/1994 Gottschald et al. ..... 451/69
5,398,460 A * 3/1995 Joncour ..... 451/42
5,538,459 A * 7/1996 Gottschald et al. ..... 451/11

FOREIGN PATENT DOCUMENTS

| | | |
|---|---|---|
| FR | 2 499 442 | 8/1982 |
| FR | 2 728 187 | 6/1996 |

* cited by examiner

*Primary Examiner*—Leo Picard
*Assistant Examiner*—Sheela Rao
(74) *Attorney, Agent, or Firm*—Young & Thompson

(57) ABSTRACT

A method is disclosed of mounting a lens in either rim or surround of a spectacle frame in which each rim or surround has a rigid part and a filament which extends from one end of the rigid part to the other. The curvature of the rigid part is systematically taken into account over the portion of the trajectory of the necessary groove that corresponds to the rigid part concerned of the spectacle frame. Applications include corresponding spectacle frames.

15 Claims, 1 Drawing Sheet

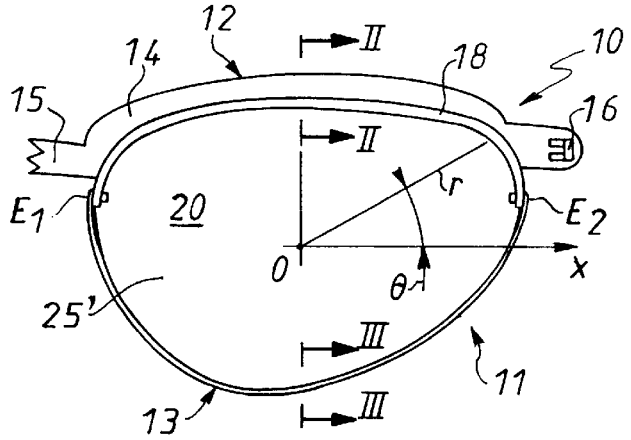
FIG 1
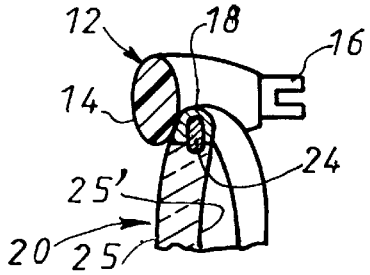
FIG 2
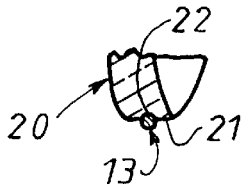
FIG 3
FIG 4
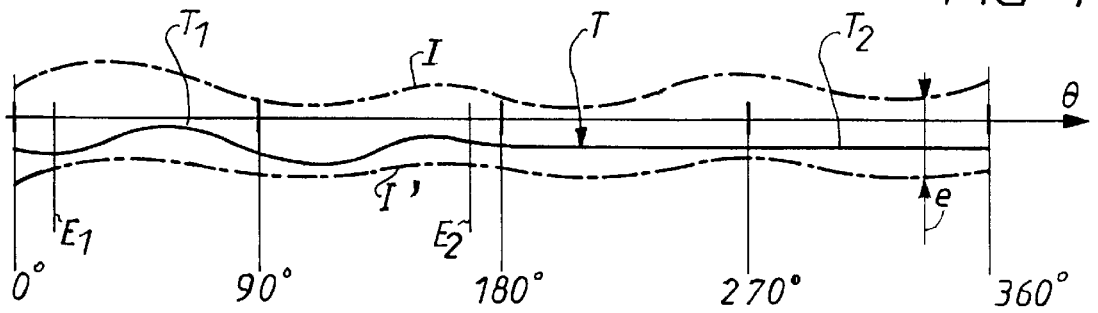

METHOD OF DETERMINING THE TRAJECTORY OF THE GROOVE TO BE MACHINED IN THE EDGE OF A LENS TO BE FITTED TO A "METAL SUPRA" TYPE SPECTACLE FRAME

BACKGROUND OF THE INVENTION

1. Field of the Invention

The present invention is generally concerned with spectacle frames of the "metal supra" type, i.e. frames like those sold under the trade name "Nylor" in which each rim or surround has a rigid part and a filament extending from one end of the rigid part to the other.

2. Description of the Prior Art

A groove must be machined into the edge of the lens to be mounted in a rim or surround of the above kind to trap the filament.

In practise, the groove extends continuously all around the lens and the rigid part of the rim or surround of the spectacle frame has a projecting bead, commonly referred to as a cushion, adapted to engage in the groove where it is not filled by the filament.

Only the shape of the lens, i.e. the shape of the contour of the lens, which is in practise determined by a contour reader relating to a flat template of the appropriate shape, is currently taken into account in determining the trajectory of the groove on the edge of the lens for controlling the grooving machine when machining the groove.

Then the groove is merely made to remain within the boundaries of the edge of the lens.

To this end, the groove is usually machined at a fixed distance from one face of the lens or halfway between its two faces.

The groove machined in this way therefore at best follows the inherent curvature of the lens.

Although the filament can adapt to this curvature of its own accord, given its inherent flexibility, this is clearly not the case for the rigid part of the rims or surrounds of the spectacle frame.

This rigid part is itself manufactured with some degree of curvature, which is not necessarily the same as that of the lens to be mounted in it.

Accordingly, when it is practicable, i.e. when the spectacle frame lends itself to this, as is the case when the spectacle frame is made of metal, for example, practitioners fitting the lens must apply an estimated twist to the rigid part of the rims or surrounds of the spectacle frame to match the curvature of the rigid part as closely as they can to that of the groove on the lens to be mounted in the frame.

This twisting is a delicate operation and difficult to control.

If practitioners do not apply this twist, or if this is impossible because the spectacle frame does not lend itself to twisting, the lens is not securely held in the rim or surround in which it is mounted and the aesthetic result is generally not entirely satisfactory.

A general object of the present invention is an arrangement intended to overcome this problem.

SUMMARY OF THE INVENTION

The present invention consists in a method of determining the trajectory of a groove to be machined in an edge of a lens intended to be fitted to a spectacle frame in which each rim or surround has a rigid part and a filament which extends from one end of the rigid part to the other end thereof, wherein the curvature of an active portion of the rigid part is systematically taken into account over a portion of the trajectory of the groove corresponding to the rigid part concerned of the spectacle frame.

Accordingly, over the portion of its trajectory corresponding to the rigid part of the spectacle frame, the groove follows the inherent curvature of the rigid part as well as it can, even perfectly, instead of following that of the lens, it being understood that the two curvatures must obviously be compatible for the results to be satisfactory.

The cushion provided for this purpose on the rigid part can then nest exactly and throughout its length in the groove in the lens, to the benefit of the retention thereof.

Over the portion of its trajectory corresponding to the filament, the groove is formed in the usual manner.

However, within limits set by the curvature and thickness of the lens, the groove preferably of itself corresponds to a minimal curvature so that, following the shortest possible trajectory, the filament is itself tensioned as well as it can be, which again is to the benefit of the retention of the lens.

Be this as it may, because of the arrangement in accordance with the invention, the groove formed on the edge of the lens has two separate portions of different appearance, namely a portion corresponding to the rigid part of the spectacle frame which is more or less sinuous and a portion corresponding to the filament which is substantially rectilinear.

Of course, the two portions of the groove are continuous with each other, joining tangentially to each other, to prevent any distortion at the corresponding junction points.

The features and advantages of the invention emerge from the following description given by way of example and with reference to the accompanying diagrammatic drawing.

BRIEF DESCRIPTION OF THE DRAWING

FIG. 1 is a partial elevation view of a "metal supra" type spectacle frame to which the invention is addressed, as seen from the rear, with a lens fitted in the rim or surround shown.

FIGS. 2 and 3 are partial views to a larger scale and in cross section taken along the respective lines II—II and III—III in FIG. 1.

FIG. 4 is a diagram showing the trajectory of the groove on the edge of the lens developed flat.

DETAILED DESCRIPTION OF THE PREFERRED EMBODIMENT

As shown in the figures, and in a conventional manner, each rim or surround 11 of the spectacle frame 10 to which the invention is particularly addressed has, in the manner of "metal supra" type spectacle frames, a rigid part 12 and a filament 13 which extends from one end $E_1$ to the other end $E_2$ of the rigid part 12.

A spectacle frame 10 of the above kind is conventional in itself and is not described in complete detail here.

Suffice to say that, in the embodiment shown, the rigid part 12 of its rims or surrounds 11 comprises two parts fastened together, namely a front bar 14 which is in one piece with the bridge 15 of the frame, for example, and carries the hinge members 16 for articulating a temple, and a rack 18 to which the filament 13 is attached.

For example, the front bar 14 is made of a synthetic material and the rack 18 is made of metal.

The manner of attaching the filament 13 to the rack 18 is conventional and is not described further here.

In order to mount the lens 20 in either rim or surround 11 of a spectacle frame 10 of the above "metal supra" kind, a groove 22 must be machined on the edge 21 of the lens 20 to trap the filament 13.

As previously indicated, the groove 22 in practise extends continuously all round the lens 20 and the rigid part 12 has a projecting bead-like cushion 24 which is also adapted to be inserted into the portion of the groove 22 between its ends $E_1$, $E_2$ which is not occupied by the filament 13.

In the embodiment shown, the cushion 24 is clearly part of the rack 18.

For example, and as shown, the rack 18 has a U-shaped profile in cross section and the cushion 24 is formed by a tongue inserted in the rack 18.

The groove 22 is machined on a grooving machine in a conventional way.

In practise, the lens 20 is first trimmed to the required final shape from an initially circular contour blank.

The contour of the final shape is read off first, for example from a flat template.

In practise, the lens 20 has some curvature, with an overall curvature in each of two orthogonal planes, and the rigid part 12 of the rims or surrounds 11 of the spectacle frame 10 also has some degree of curvature, not necessarily the same as that of the lens.

The curvature of the lens 20 can be characterized by the bases B, B' of its faces, i.e. by the base B of its front face 25 and the base B' of its rear face 25'.

The bases B, B' are defined by the following equation:

$$B = \frac{n-1}{R} \qquad B' = \frac{n-1}{R'}$$

in which R and R' are the radii of the faces 25, 25' concerned and n is the refractive index.

By extension, the curvature of the rigid part 12 of the rims or surrounds 11 of a spectacle frame 10 can be characterized by the equivalent of a base of this kind, i.e. by a magnitude that is inversely proportional to the radius of the sphere on which the cushion 24 is inscribed.

According to the invention, the curvature of the active portion of the rigid part 12 is systematically taken into account in determining the trajectory of the groove 22 to be machined on the edge 21 of a lens 20 to be fitted to a "metal supra" type spectacle frame 10, to be more precise the portion of the trajectory of the groove 22 corresponding to the rigid part 12 of the spectacle frame 10 concerned.

When, as here, the rigid part 12 of the spectacle frame 10 has a cushion 24, the active portion of the rigid part 12 whose curvature is taken into account is preferably the cushion 24.

In the rigid part 12, the cushion 24 can have a trajectory such that its inherent curvature is not identical to that of the remaining portion of the rigid part 12.

For example, in a first embodiment of the invention, a parameter related to the curvature of the active portion of the rigid part 12 of the spectacle frame 10 is taken into account for controlling the grooving machine, in addition to the results of reading off a contour relating to the shape of the lens 20, as previously.

The parameter taken into account in this way is preferably a magnitude inversely proportional to the radius of the sphere on which the active portion of the rigid part 12 of the spectacle frame 10, i.e. its cushion 24, is inscribed.

In other words, in this first embodiment of the invention, after reading off the contour relating to the shape of the lens 20, the practitioner enters into the grooving machine the position on the rim or surround 11 concerned of the rigid part 12 thereof and the base of that rigid part 12.

Alternatively, in a different embodiment of the invention, the results of reading a contour relating to the active portion of the rigid part 12 of the spectacle frames 10, i.e. the cushion 24 of the rigid part 12, and specifying the position thereof relative to the lens 20, are taken into account in controlling the grooving machine, in addition to the results of reading a contour relating to the shape of the lens 20, as previously.

In other words, in this second embodiment of the invention, which is more highly automated, the practitioner carries out two contour readings, one on the template to read off the shape of the lens 20 and one on the rigid part 12 of the spectacle frame 10, to be more precise on the cushion 24 of the rigid part 12, to read off its curvature and its position.

In either case, the positions of the ends $E_1$, $E_2$ of is the rigid part 12 of the spectacle frame 10 are also identified and the grinding machine is controlled accordingly, being supplied with the coordinates of the ends $E_1$, $E_2$.

In either case, the grooving machine, which is appropriately programmed for this purpose, then itself calculates the trajectory T of the groove 22 on the edge 21 of the lens 20.

Over the portion of the trajectory T corresponding to the filament 13, the corresponding programming is preferably such that, within limits authorized by the curvature of the lens 20, i.e. within limits authorized by the bases B, B' of the front face 25 and rear face 25' and within limits authorized by the thickness e of the lens 20, this portion of the trajectory T of itself corresponds to a minimal curvature so that, as previously indicated, the filament 13 follows the shortest possible trajectory and is easier to tension.

According to the invention, and as already emphasized hereinabove, the trajectory T of the groove 22, and thus the groove 22 itself, have two successive separate portions $T_1$, $T_2$ of different appearance, as shown in the FIG. 4 diagram in which the trajectory T is plotted as a function of the angle θ between an arbitrary reference axis OX (see FIG. 1) and the radius r of each successive point along the groove 22.

The portion $T_1$, which corresponds to the rigid part 12 of the rim or surround 11 concerned, and which therefore extends from one end $E_1$ of the rigid part 12 to the other end $E_2$, is generally sinuous, having two maxima and two minima, for example.

The portion $T_2$, which corresponds to the filament 13, is substantially rectilinear, although it can be very slightly curved, for example.

Of course, the two portions $T_1$, $T_2$ of the trajectory T of the groove 22 are continuous with each other, preferably joining tangentially to each other, by virtue of an appropriate polynomial curve.

The FIG. 4 diagram also shows in chain-dotted line images I, I' of the front face 25 and the rear face 25' of the lens 20 at the level of the outline thereof, i.e. in practise at the level of its edge.

Note that the maxima and minima of the portion $T_1$ of the trajectory T of the groove 22 do not coincide exactly with those of the images I, I'.

Of course, the present invention is not limited to the embodiments described and shown, but encompasses any variant execution thereof.

There is claimed:

1. Method of determining the trajectory of a groove to be machined in an edge of a lens adapted to be fitted to a spectacle frame, each rim or surround of the spectacle frame having a rigid part with an operative portion and a filament extending from an end of the rigid part to another end thereof, the operative portion of the rigid part and the filament being adapted to be received in a groove machine in an edge of a lens, the method comprising the steps of:

providing a first set of data corresponding to the curvature of the front and rear faces of the lens, and providing a second set of data corresponding to the curvature of the operative portion of the rigid part, and determining the trajectory of the groove to be machined in the portion of the edge of the lens corresponding to the operative portion of the rigid part of the spectacle frame as a function of the first and second sets of data.

2. The method claimed in claim 1, wherein the first set of data corresponds to a contour reading of the shape of the lens and the second set of data corresponds to a parameter related to the curvature of the operative portion of the rigid part.

3. The method claimed in claim 1, wherein the second set of data corresponds to a parameter inversely proportional to the radius of a sphere on which the active portion of the rigid part lies.

4. The method claimed in claim 1, wherein the active portion of the rigid frame comprises a projecting beadlike cushion which is adapted to be received in the corresponding portion of the groove in the lens.

5. The method claimed in claim 1, wherein the trajectory of the groove adapted to receive the filament has minimal curvature, within limits permitted by the curvature of the lens and the thickness of the lens.

6. The method claimed in claim 1, wherein the trajectory of the groove adapted to receive the active portion of the rigid part is of sinuous curvature.

7. The method claimed in claim 1, further comprising the step of determining the position of the ends of the rigid part of the rim or surround of the spectacle frame, the position of the ends defining the respective limits of the portion of the groove for receiving the filament and the portion of the groove receiving the active portion of the rigid part.

8. A method of determining the trajectory of a groove to be machined in an edge of a lens intended to be fitted in a spectacle frame in which each rim or surround has a rigid part and a filament which extends from one end of the rigid part to the other end of the rigid part, a parameter of the curvature of an active portion of the rigid part being systematically taken into account over a portion of the trajectory of the groove corresponding to the active portion of the rigid part of the spectacle frame, the parameter being a magnitude inversely proportional to the radius of a sphere on which the active portion of the rigid part of the spectacle frame is inscribed.

9. A method for machining a groove in an lens of a lens to be fitted to a spectacle frame, each rim or surround of the spectacle frame having a rigid part and a filament extending from an end of the rigid part to another end thereof, the method comprising the steps of: providing a first set of data corresponding to the curvature of the front and rear faces of the lens, providing a second set of data corresponding to the curvature of an active portion of the rigid part, and determining the trajectory of the groove in the portion of the edge of the lens corresponding to the active portion of the rigid part as a function of the first and second sets of data, and controlling a grinding machine to machine a groove in a lens according to the trajectory.

10. The method claimed in claim 9, wherein the first set of data corresponds to a contour reading of the shape of the lens and the second set of data corresponds to a parameter related to the curvature of the operative portion of the rigid part.

11. The method claimed in claim 10, wherein the parameter is inversely proportional to the radius of a sphere on which the active portion of the rigid part lies.

12. The method claimed in claim 9, wherein the active portion of the rigid frame comprises a projecting beadlike cushion which is adapted to be received in the corresponding portion of the groove in the lens.

13. The method claimed in claim 9, wherein the trajectory of the groove adapted to receive the filament has minimal curvature, within limits permitted by the curvature of the lens and the thickness of the lens.

14. The method claimed in claim 9, wherein the trajectory of the groove adapted to receive the active portion of the rigid part is of sinuous curvature.

15. The method claimed in claim 9, further comprising the step of determining the position of the ends of the rigid part of the rim or surround of the spectacle frame, the position of the ends defining the respective limits of the portion of the groove for receiving the filament and the portion of the groove receiving the active portion of the rigid part.

* * * * *